US012759832B2

(12) United States Patent
Nishimura et al.

(10) Patent No.: US 12,759,832 B2
(45) Date of Patent: Oct. 13, 2026

(54) SHEET POST-PROCESSING APPARATUS AND IMAGE FORMING SYSTEM INCLUDING THE APPARATUS

(71) Applicant: KYOCERA Document Solutions Inc., Osaka (JP)

(72) Inventors: Takuya Nishimura, Osaka (JP); Keisuke Egawa, Osaka (JP); Terumitsu Noso, Osaka (JP); Takehiko Okada, Osaka (JP); Yasunori Ueno, Osaka (JP); Seiichi Shirasaki, Osaka (JP); Yusuke Takano, Osaka (JP); Shinya Aono, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 284 days.

(21) Appl. No.: 18/750,308

(22) Filed: Jun. 21, 2024

(65) Prior Publication Data

US 2025/0002287 A1 Jan. 2, 2025

(30) Foreign Application Priority Data

Jun. 29, 2023 (JP) ..... 2023-106827

(51) Int. Cl.
*B65H 31/36* (2006.01)
*B65H 43/00* (2006.01)

(52) U.S. Cl.
CPC ..... *B65H 31/36* (2013.01); *B65H 43/00* (2013.01); *B65H 2513/50* (2013.01); *B65H 2701/1311* (2013.01); *B65H 2801/27* (2013.01)

(58) Field of Classification Search
CPC ..... B65H 31/02; B65H 31/36; B65H 43/00; B65H 2513/50; B65H 2701/131;
(Continued)

(56) References Cited

U.S. PATENT DOCUMENTS 6,268,909 B1 * 7/2001 Honmochi ..... G03G 15/6582 355/25
6,607,188 B2 * 8/2003 Sato ..... B65H 37/04 227/111
(Continued)

FOREIGN PATENT DOCUMENTS

JP 2017-036115 A 2/2017

*Primary Examiner* — Leslie A Nicholson, III
(74) *Attorney, Agent, or Firm* — Stein IP, LLC

(57) ABSTRACT

A sheet post-processing apparatus includes a first conveying member, a processing tray, a first processing unit, a reference plate, an alignment member, a home-position detection unit, a drive unit, and a control portion. The alignment member has a shaft joined to a drive unit to rotate, and one or more alignment paddles protruding in a radial direction of the shaft. The control portion calculates a contact assumed interval in which the trailing end of the sheets may make contact with the alignment paddle and an interference timing at which the alignment paddle interferes with a carry-in path of the sheets. If the interference timing falls within the contact assumed interval, the control portion temporarily changes the rotation speed of the alignment member from a reference speed to shift the phase of the alignment paddle so that the interfere timing falls outside the contact assumed interval.

10 Claims, 8 Drawing Sheets

(58) Field of Classification Search
CPC ..... B65H 2701/1311; B65H 2404/72; B65H 2801/27; B65H 2408/114; B65H 2301/36; B65H 2301/362; B65H 2301/363
USPC ..... 270/58.07, 58.08, 58.12, 58.17, 58.27
See application file for complete search history.

(56) References Cited

U.S. PATENT DOCUMENTS

| | | | | |
|---|---|---|---|---|
| 8,496,244 | B2 * | 7/2013 | Iljima ..... | B65H 31/3009 271/220 |
| 11,858,773 | B2 * | 1/2024 | Mitsui ..... | B65H 31/02 |
| 2017/0043972 | A1 | 2/2017 | Noso et al. ..... | B65H 35/0006 |

* cited by examiner

SHEET POST-PROCESSING APPARATUS AND IMAGE FORMING SYSTEM INCLUDING THE APPARATUS

INCORPORATION BY REFERENCE

This application is based on and claims the benefit of priority from Japanese Patent Application No. 2023-106827 filed on Jun. 29, 2023, the contents of which are hereby incorporated by reference.

BACKGROUND

The present disclosure relates to a sheet post-processing apparatus that executes a predetermined post process onto sheets on which images have been formed by an image forming apparatus, and to an image forming system including such a sheet post-processing apparatus.

Known sheet post-processing apparatuses execute processes such as a binding process of stapling a bundle of a plurality of stacked sheets on which images have been formed by an image forming apparatus such as a copying machine or a printer, a punching process of forming punched holes (perforations) by use of a punching apparatus, and a folding process of forming folds in the sheets.

In such sheet post-processing apparatuses, a processing tray on which a predetermined number of sheets having images formed on them are stacked is provided. Further, the processes such as a binding process and a shifted discharge process (sorting process) are executed onto the plurality of sheets stacked on the processing tray. Still further, in order that the processes such as the binding process and the shifted discharge process are smoothly executed, the sheets on the processing tray are aligned by use of an alignment member such as an alignment paddle.

SUMMARY

According to one aspect of the present disclosure, a sheet post-processing apparatus includes a first conveying member, a processing tray, a first processing unit, a reference plate, an alignment member, a home-position detection unit, a drive unit, and a control portion. The first conveying member conveys a sheet. The sheet detection unit is arranged on the upstream side of the first conveying member in the sheet conveying direction and detects the passage of the sheet. On the processing tray are stacked sheets that are carried in along the predetermined carry-in direction by the first conveying member. The first processing unit executes a predetermined post process onto the sheets that are stacked on the processing tray. The reference plate aligns the sheets in the carry-in direction by abutting against the downstream edge of the sheets in the alignment direction that is opposite to the carry-in direction of the sheets that are carried in onto the processing tray. The alignment member has a shaft which is arranged above the processing tray and rotates, and one or more alignment paddles which protrude in a radial direction of the shaft and which make contact with the sheets having been carried in on the processing tray. The alignment member rotates in the alignment direction on the surface facing the processing tray to move the sheets having been carried in on the processing tray in the alignment direction, and thereby assists in aligning the sheets. The home-position detection unit detects the alignment paddle being at a reference position. The drive unit drives the alignment member. The control portion controls the drive unit. The control portion calculates a contact assumed interval in which the trailing end of the sheets carried in in the alignment direction may make contact with the alignment paddle based on output information of the sheets. The control portion calculates an interference timing at which the alignment paddle interferes with a carry-in path of the sheets based on the result of detection by the home-position detection unit. If the interference timing falls within the contact assumed interval, the control portion temporarily changes the rotation speed of the alignment member from a reference speed to shift the phase of the alignment paddle so that the interfere timing falls outside the contact assumed interval.

DETAILED DESCRIPTION

[1. Configuration of Image Forming System]

Figure 1:
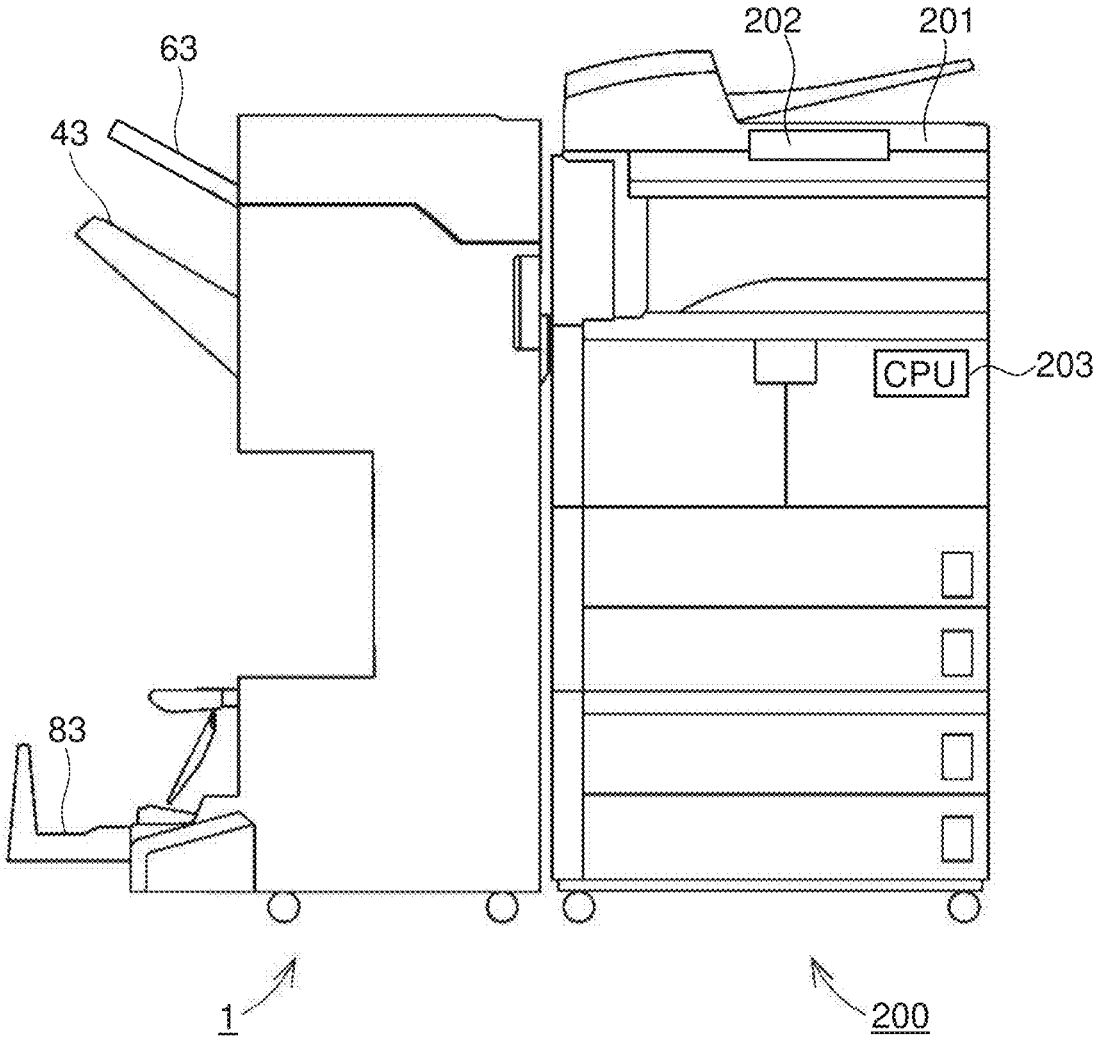
FIG. 1 is a schematic diagram illustrating a configuration of an image forming system that is constituted by a sheet post-processing apparatus according to one embodiment of the present disclosure and an image forming apparatus to which the sheet post-processing apparatus is joined.

Now, an embodiment of the present disclosure is described in detail with reference to the accompanying drawings. FIG. 1 is a schematic view illustrating a configuration of an image forming system that is constituted by a sheet post-processing apparatus 1 according to the embodiment of the present disclosure, and by an image forming apparatus 200 to which the sheet post-processing apparatus 1 is joined.

As illustrated in FIG. 1, the image forming apparatus 200 prints images onto sheets (paper) on the basis of image data input from an outside via a network communication unit (not shown), or of image data read by an image reading unit 201 arranged in an upper portion of the image forming apparatus 200. In this embodiment, the image forming apparatus 200 is an ink-jet recording apparatus including a recording head (not shown) corresponding to colors and having a large number of nozzle ports through which inks are ejected onto the sheets.

An operation panel 202 is arranged in the front of the image reading unit 201. The operation panel 202 is an operation unit for accepting various setting inputs. For example, a user can input size information of the sheets by operating the operation panel 202. In addition, by operating the operation panel 202, the user can also input the number of the sheets to be printed, and can issue an instruction to start a print job. A main body control portion 203 controls the units in the image forming apparatus 200 by coordinating operation of an entirety of the image forming apparatus 200.

The sheet post-processing apparatus 1 is joined to be removable to a side surface of the image forming apparatus 200. The sheet post-processing apparatus 1 executes post-processes such as a perforating (punching) process and a binding process onto the sheets that have been subjected to image formation (printed) by the image forming apparatus 200. Note that, the sheet post-processing apparatus 1 need not necessarily execute the post-processes onto the sheets that are automatically conveyed from the image forming apparatus 200, and may execute the post-processes onto sheets that are set on a tray (not shown) by the user and then conveyed by the sheet post-processing apparatus 1 itself to a position where the post-processes can be executed.

[2. Configuration of Sheet Post-Processing Apparatus]

Figure 2:
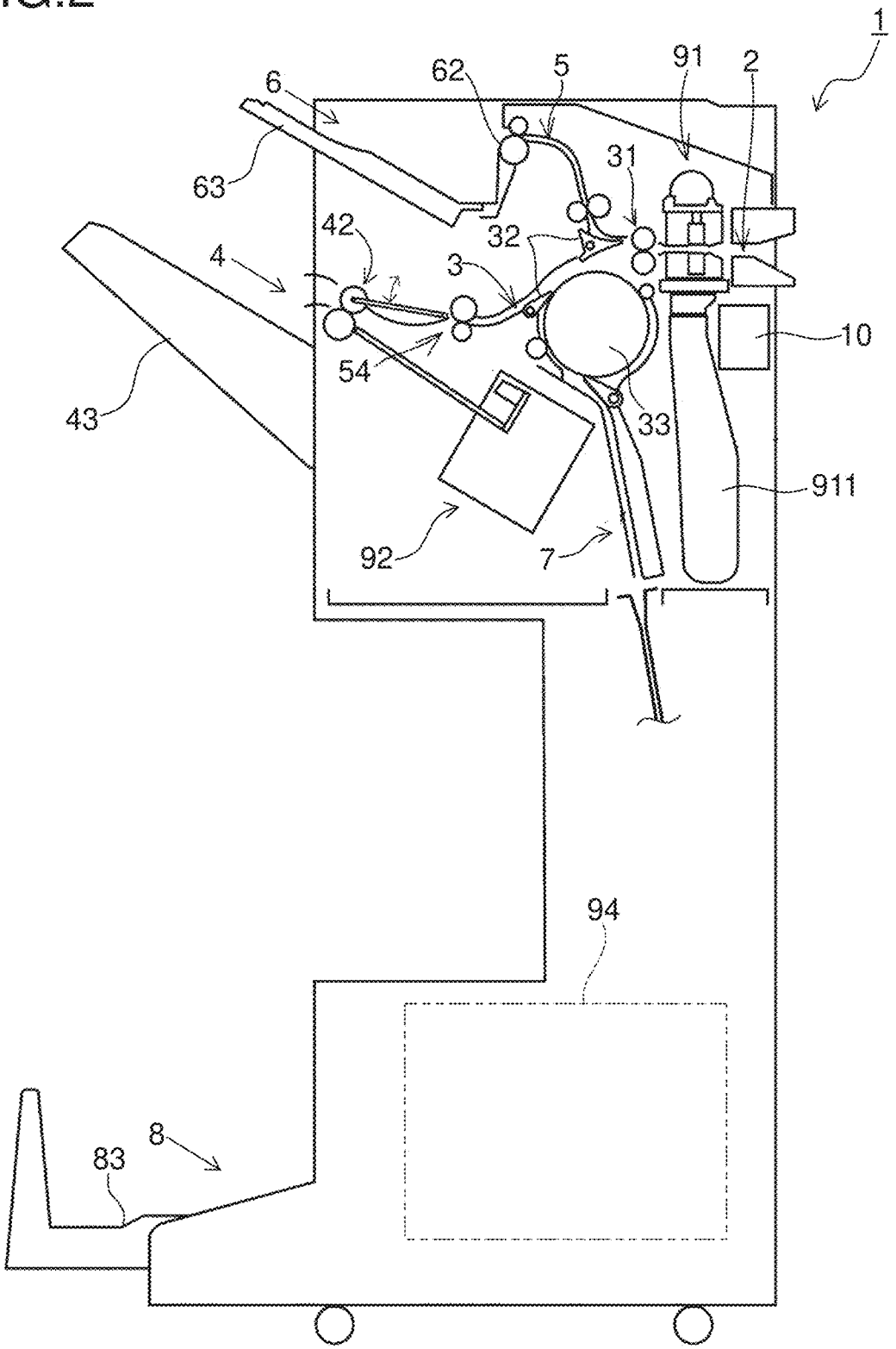
FIG. 2 is a sectional side view schematically illustrating a configuration of the sheet post-processing apparatus according to the embodiment.

FIG. 2 is a schematic cross-sectional side view illustrating a configuration of the sheet post-processing apparatus 1 according to this embodiment. As illustrated in FIG. 2, the sheet post-processing apparatus 1 includes a sheet carry-in port 2, a first sheet-conveying path 3, a first sheet-discharge section 4, a second sheet-conveying path 5, a second sheet-discharge section 6, a third sheet-conveying path 7, a third sheet-discharge section 8, a perforating unit 91, a sheet binding unit 92, a bookbinding unit 94, and a post-processing control portion (control portion) 10.

The sheet carry-in port 2 is an opening that is provided in a side surface of the sheet post-processing apparatus 1, the side surface facing the image forming apparatus 200. The sheets conveyed from the image forming apparatus 200 to the sheet post-processing apparatus 1 are carried into the sheet post-processing apparatus 1 through the sheet carry-in port 2.

The first sheet-conveying path 3 extends from the sheet carry-in port 2 to the first sheet-discharge section 4 substantially horizontally in a direction away from the image forming apparatus 200 (left direction in FIG. 2). Note that, this direction from the sheet carry-in port 2 to the first sheet-discharge section 4 is referred to as a "sheet conveying direction of the first sheet-conveying path 3." The sheet carry-in port 2 is located at an upstream end in the sheet conveying direction of the first sheet-conveying path 3. The first sheet-conveying path 3 includes an upstream side conveying roller pair 31 and a middle conveying roller pair 54, which convey the sheets carried in the sheet post-processing apparatus 1 through the sheet carry-in port 2 toward a downstream side in the sheet conveying direction.

Two switching guides 32 are arranged in the first sheet-conveying path 3. The switching guide 32 on an upstream side (right side in FIG. 1) in the sheet conveying direction of the first sheet-conveying path 3 is arranged at a branch portion of the second sheet-conveying path 5, and pivots between a position at which the sheets that are conveyed in the first sheet-conveying path 3 from the side where the sheet carry-in port 2 is present are guided to a first sheet-discharge section 4 along the first sheet-conveying path 3 and a position at which the sheets are diverted from the first sheet-conveying path 3 and then guided to the second sheet-conveying path 5.

The switching guide 32 on a downstream side (left side in FIG. 1) in the sheet conveying direction of the first sheet-conveying path 3 is arranged at a branch portion of the third sheet-conveying path 7, and pivots between a position at which the sheets that are conveyed in the first sheet-conveying path 3 from the side where the sheet carry-in port 2 is present are guided to the first sheet-discharge section 4 along the first sheet-conveying path 3 and a position at which the sheets are diverted from the first sheet-conveying path 3 and then guided to the third sheet-conveying path 7. The switching guide 32 is connected to a drive mechanism (not shown), and is operated under the control of the post-processing control portion 10.

A retraction roller 33 is arranged under the first sheet-conveying path 3. While executing predetermined post processes onto the preceding sheets, the subsequent sheets are retracted along the outer circumferential surface of the retraction roller 33. With this, the processing efficiency is enhanced when post-processing is executed on the sheets continuously.

The first sheet-discharge section 4 is provided to the other side surface being on a side opposite to the side surface facing the image forming apparatus 200. The first sheet-discharge section 4 includes a first discharge-roller pair 42 and a first discharge tray 43.

The first discharge-roller pair 42 is arranged at the downstream end in the sheet conveying direction of the first sheet-conveying path 3. The first discharge tray 43 is located on a downstream side of the first discharge-roller pair 42 in the sheet conveying direction. The sheets that have been conveyed in the first sheet-conveying path 3 and reached the downstream end in the sheet conveying direction of the first sheet-conveying path 3 are discharged by the first discharge-roller pair 42 onto the first discharge tray 43. The first discharge tray 43 is one of discharge destinations of the sheets that have been subjected to the post processes by the sheet post-processing apparatus 1.

The second sheet-conveying path 5 branches upward from the first sheet-conveying path 3, and extends to the second sheet-discharge section 6 obliquely upward in the direction away from the image forming apparatus 200 (left direction in FIG. 2). The second sheet-conveying path 5 branches closely downstream of the upstream side conveying roller pair 31 in the sheet conveying direction of the first sheet-conveying path 3. Note that, a direction from the upstream side conveying roller pair 31 to the second sheet-discharge section 6 is referred to as a "sheet conveying direction of the second sheet-conveying path 5." The second sheet-conveying path 5 includes a plurality of conveying roller pairs, which divert the sheets conveyed in the first sheet-conveying path 3 to convey them toward the second sheet-discharge section 6.

The second sheet-discharge section 6 is provided to the other side surface being on a side opposite to the side surface facing the image forming apparatus 200, the second sheet-discharge section 6 being provided above the first sheet-discharge section 4. The second sheet-discharge section 6 includes a second discharge-roller pair 62 and a second discharge tray 63.

The second discharge-roller pair 62 is arranged at the downstream end in the sheet conveying direction of the second sheet-conveying path 5. The second discharge tray 63 is located on a downstream side of the second discharge-roller pair 62 in the sheet conveying direction. The sheets that have been conveyed in the second sheet-conveying path 5 and reached the downstream end in the sheet conveying direction of the second sheet-conveying path 5 are discharged by the second discharge-roller pair 62 onto the second discharge tray 63. The second discharge tray 63 is another one of the discharge destinations of the sheets that have been subjected to the post processes by the sheet post-processing apparatus 1. In addition, sheets that are not subjected to the post-processes, sheets of small sizes, and the like are also discharged onto the second discharge tray 63.

The third sheet-conveying path 7 branches downward from the first sheet-conveying path 3, and extends downward to the third sheet-discharge section 8. The third sheet-conveying path 7 branches downstream of the branch portion of the second sheet-conveying path 5 in the sheet conveying direction of the first sheet-conveying path 3. Note that, a direction from the branch portion of the first sheet-conveying path 3 to the third sheet-discharge section 8 is referred to as a "sheet conveying direction of the third sheet-conveying path 7." The third sheet-conveying path 7 includes a plurality of conveying roller pairs, which divert the sheets conveyed in the first sheet-conveying path 3 to convey them toward the bookbinding unit 94 and the third sheet-discharge section 8.

The third sheet-discharge section 8 is provided to the other side surface being on a side opposite to the side surface facing the image forming apparatus 200, the third sheet-discharge section 8 being provided below the first sheet-discharge section 4 (near a lower end portion of the sheet post-processing apparatus 1). The third sheet-discharge section 8 includes a third discharge-roller pair (not shown) and a third discharge tray 83.

The sheets that have been conveyed in the third sheet-conveying path 7 and reached the downstream end in the sheet conveying direction of the third sheet-conveying path 7 are discharged by the third discharge-roller pair onto the third discharge tray 83. The third discharge tray 83 is a still another one of the discharge destinations of the sheets that have been subjected to the post processes by the sheet post-processing apparatus 1.

The perforating unit 91 is arranged closely on the downstream side of the sheet carry-in port 2 in the first sheet-conveying path 3. The perforating unit 91 executes a perforating process onto the sheets to be conveyed in the first sheet-conveying path 3. With this, punched holes are formed. A collection container 911 is arranged below the perforating unit 91. Sheet pieces resulting from the perforating process by the perforating unit 91 fall from the first sheet-conveying path 3 and are collected into the collection container 911. The collection container 911 is removably mounted in the sheet post-processing apparatus 1.

The sheet binding unit 92 is arranged closely on an upstream side of the first sheet-discharge section 4 in the sheet conveying direction of the first sheet-conveying path 3. The sheet binding unit 92 executes a stapling process (binding process) onto sheet bundles formed by stacking a plurality of sheets. With this, the sheet bundles are bound. Details of a configuration of the sheet binding unit 92 are described below.

The bookbinding unit 94 is arranged closely on an upstream side of the third sheet-discharge section 8 in the sheet conveying direction of the third sheet-conveying path 7. The bookbinding unit 94 executes a middle folding process and a middle stapling process in which a substantially middle portion in the sheet conveying direction of each of the sheet bundles formed by stacking the plurality of sheets is folded and bound. With this, booklets are formed.

The perforating unit 91, the sheet binding unit 92, and the bookbinding unit 94 are post-processing sections that execute the predetermined post-processes onto the sheets on which images have been formed by the image forming apparatus 200 and which then have been carried into the sheet post-processing apparatus 1.

The post-processing control portion (control portion) 10 includes a CPU, a storage unit, and other electronic circuits and electronic components (none of which is shown). The post-processing control portion 10 is connected to be communicable with the main body control portion 203 (refer to FIG. 1) of the image forming apparatus 200. In response to instructions from the main body control portion 203, the post-processing control portion 10 makes the CPU control the operation of the components provided in the sheet post-processing apparatus 1 on the basis of control programs and data stored in the storage unit. In this way, the post-processing control portion 10 executes processes relating to functions of the sheet post-processing apparatus 1. The first sheet-conveying path 3, the first sheet-discharge section 4, the second sheet-conveying path 5, the second sheet-discharge section 6, the third sheet-conveying path 7, the third sheet-discharge section 8, the perforating unit 91, the sheet binding unit 92, and the bookbinding unit 94 individually receive instructions from the post-processing control portion 10, and execute the post processes in conjunction with each other. Note that, functions of the post-processing control portion 10 may be implemented also by the main body control portion 203 of the image forming apparatus 200.

[3. Configuration of Sheet Binding Unit]

Figure 3:
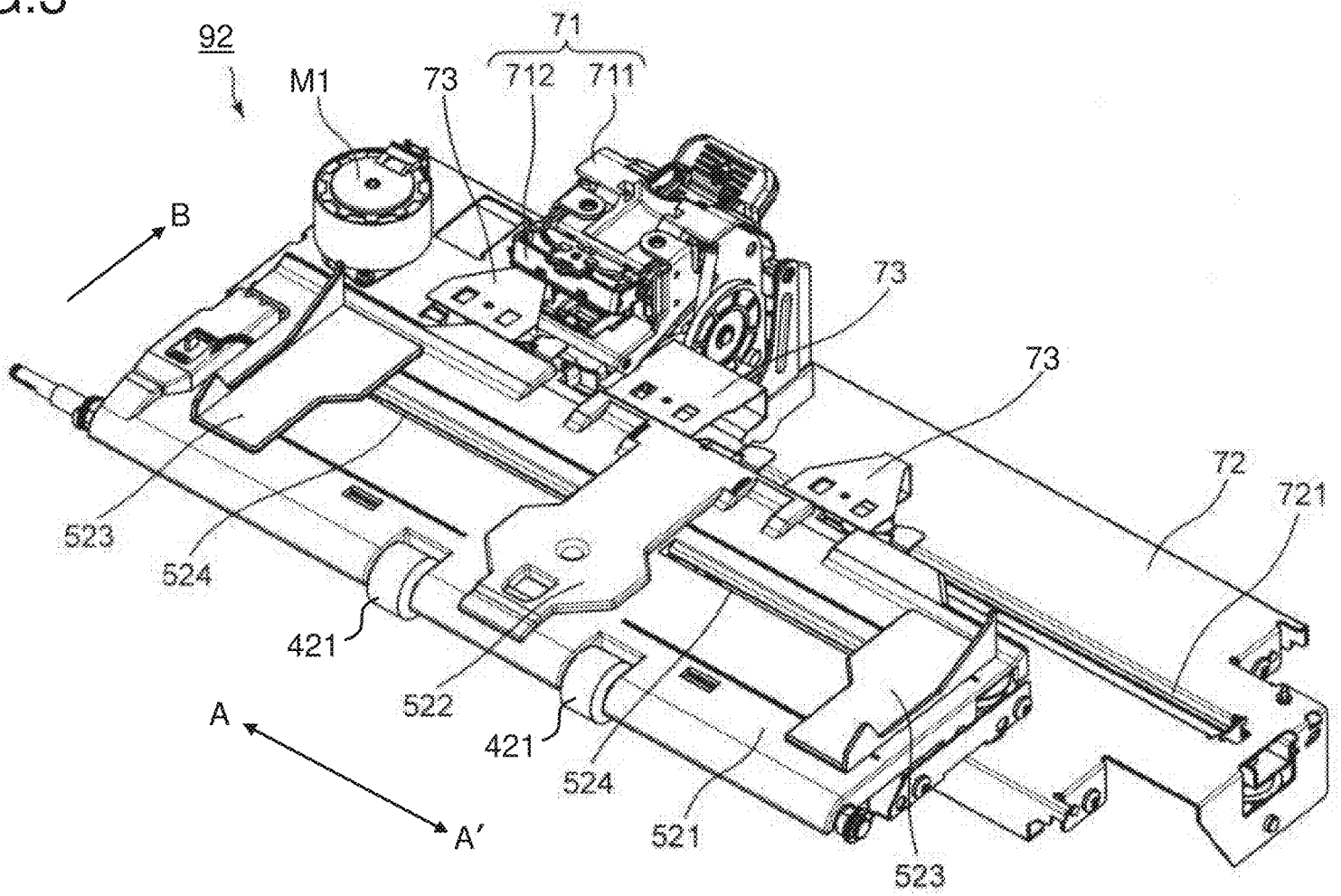
FIG. 3 is a perspective view of a sheet binding unit installed in the sheet post-processing apparatus according to the embodiment.
Figure 4:
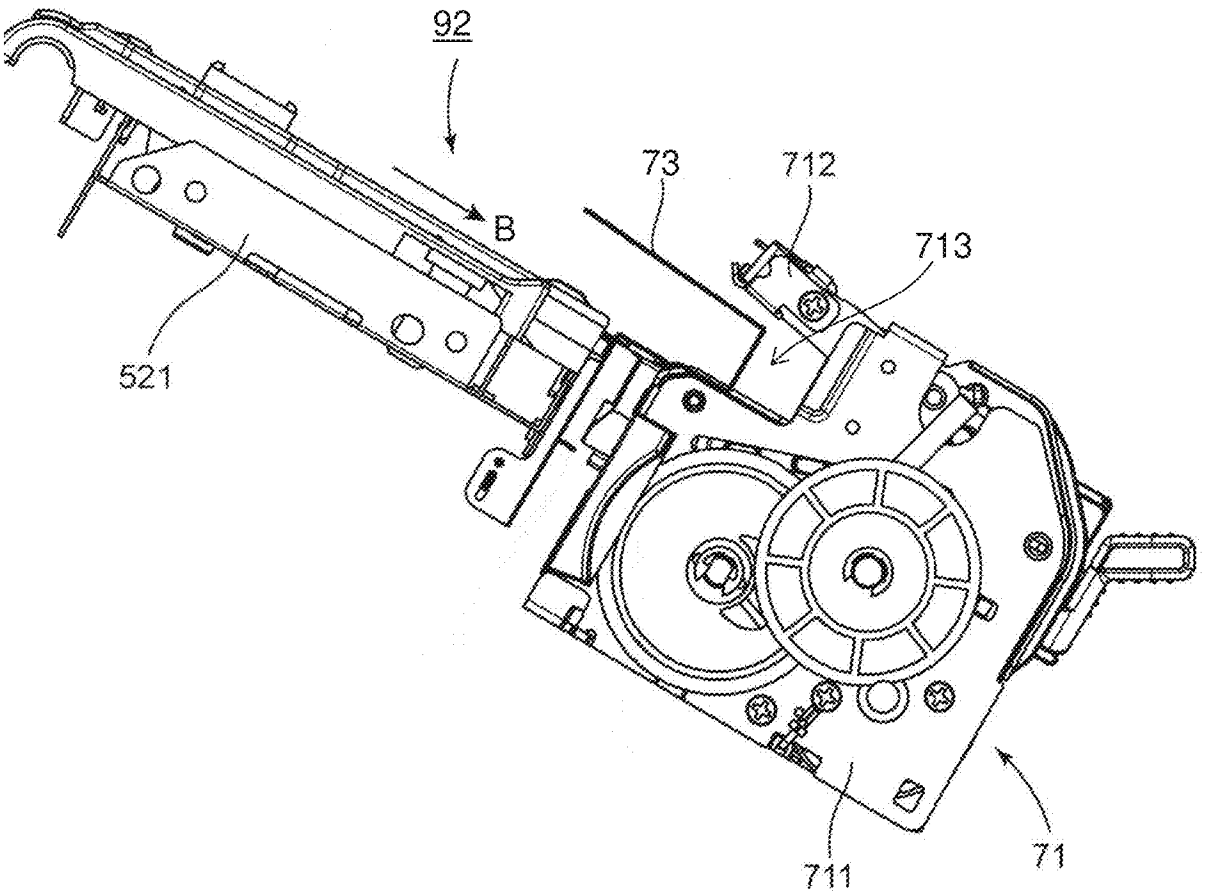
FIG. 4 is a side view of the sheet binding unit.

Next, a configuration of the sheet binding unit 92 is described. FIG. 3 is a perspective view of the sheet binding unit 92 to be installed in the sheet post-processing apparatus 1. FIG. 4 is a side view of the sheet binding unit 92.

As illustrated in FIG. 3, the sheet binding unit 92 includes a processing tray 521, a stapling unit 71, and reference plates 73.

The processing tray 521 is a rectangular tray that extends in a sheet width direction (directions of arrows A-A') and a carry-in direction. A plurality of sheets (sheet bundle) to be subjected to the stapling process are stacked on the processing tray 521. At this time, the sheets are carried in onto the processing tray 521 along an alignment direction (direction opposite to the carry-in direction) into the lower right direction in FIG. 4 (direction of an arrow B). The sheet bundle that has been subjected to the stapling process is lastly sent out into a direction opposite to the alignment direction (upper left direction in FIG. 4) by the first discharge-roller pairs 42 (refer to FIG. 2), thereby discharged onto the first discharge tray 43 (refer to FIG. 2). Discharge lower rollers 421 constituting the first discharge-roller pairs 42 are supported on a downstream side in the carry-in direction (lower left side in FIG. 3) of the processing tray 521.

The processing tray 521 includes a tray central portion 522 and width regulating members 523. The tray central portion 522 is arranged at a central portion in the sheet width direction on an upper surface portion of the processing tray 521. The tray central portion 522 is a thin-plate-like member that is fixed with a slight height onto the processing tray 521.

The width regulating members 523 are arranged in a pair in a manner that sandwiches the tray central portion 522 in the sheet width direction. The width regulating members 523 regulate positions in the sheet width direction of the sheets to be carried in onto the processing tray 521. The width regulating members 523 are each formed of a thin-plate-like member similar to the tray central portion 522, and each have a side wall provided upward at their end portions in the sheet width direction. A guide groove 524 that extends in the sheet width direction is formed in the processing tray 521. The width regulating members 523 can be reciprocated along the guide groove 524 in the sheet width direction by a drive mechanism such as a rack-and-pinion gear (not shown). In this embodiment, every time the sheets are carried in onto the processing tray 521, the width regulating members 523 are reciprocated by the drive mechanism. As a result, the sheets stacked on the processing tray 521 are aligned in the sheet width direction.

The stapling unit 71 is arranged to face edges of the sheets on their leading side in the alignment direction (right side in FIG. 4). The stapling unit 71 is movable in the sheet width direction (directions of the arrows A-A') along the edges of the sheets by driving force of a stapling-unit drive motor M1, the sheet width direction being orthogonal to the carry-in direction, and executes the stapling process onto the sheet bundles.

As illustrated in FIG. 4, the stapling unit 71 includes a stapling body portion 711 and a stapling movable portion 712. The stapling body portion 711 is a main part of the stapling unit 71, and stores a plurality of staples (not shown) therein. The stapling movable portion 712 is configured to be movable upward and downward, and staples the sheets. A recessed portion 713 into which the edges of the sheets advance is formed between the stapling body portion 711 and the stapling movable portion 712.

The reference plates 73 are fixed at three points at an interval in the sheet width direction to face an edge portion on a downstream side in the alignment direction of the processing tray 521 (upper right side in FIG. 3 and lower right side in FIG. 4). The reference plates 73 each have a substantially U-shape open on an upstream side in the alignment direction (the upper left side in FIG. 4) in cross-sectional view orthogonal to the sheet width direction. The reference plates 73 align the sheets to be carried in onto the processing tray 521 in the carry-in direction by abutting against the edges of these sheets S.

[4. Configuration of First Sheet-Conveying Path from Sheet Carry-In Port to First Sheet-Discharge Section]

Figure 5:
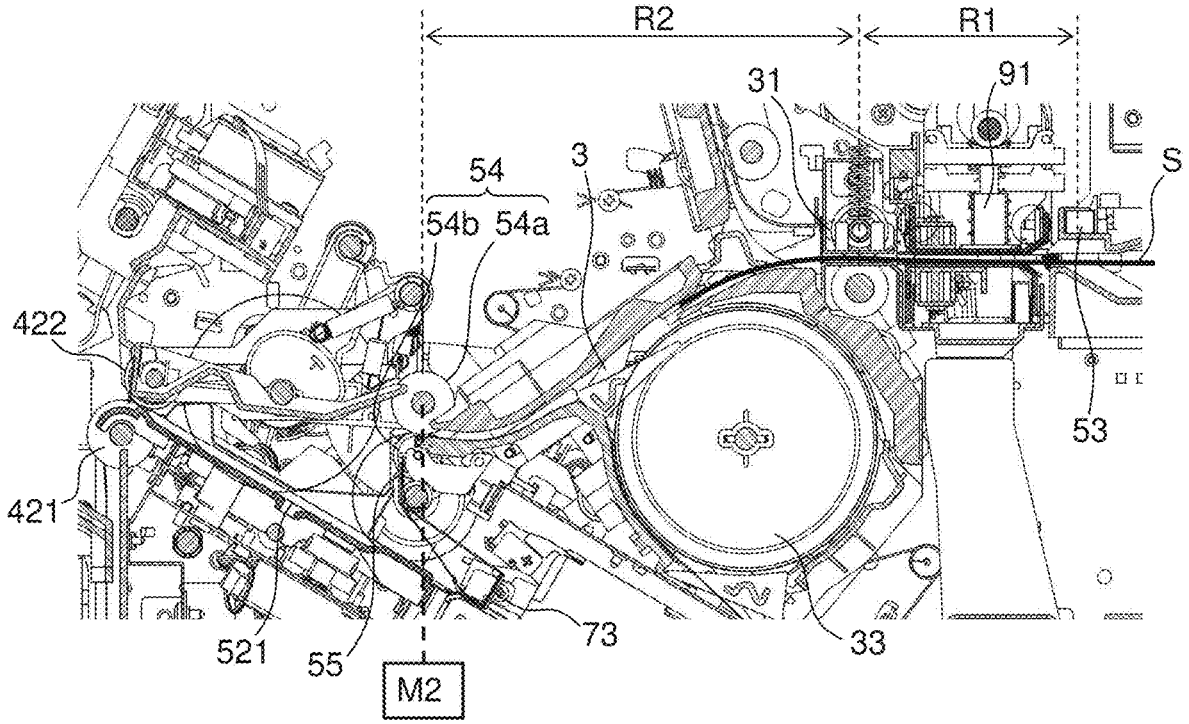
FIG. 5 is a sectional side view showing a configuration of a first sheet-conveying path from a sheet carry-in port to a first sheet-discharge section in the sheet post-processing apparatus.

FIG. 5 is a cross-sectional side view showing the configuration of the first sheet-conveying path 3 from the sheet carry-in port 2 to first sheet-discharge section 4 in the sheet post-processing apparatus 1. The operation in which the sheets S carried in from the sheet carry-in port 2 pass through the perforating unit 91 and the sheet binding unit 92 and are discharged from the first sheet-discharge section 4 is described with reference to FIG. 5.

As illustrated in FIG. 5, a sheet detection sensor 53 is arranged near the sheet carry-in port 2. The sheet detection sensor 53 detects timings when the sheets S pass through the sheet carry-in port 2. As the sheet detection sensor 53, for example, a PI (photo-interrupter) sensor including a detection unit constituted by a light emitting portion and a light receiving portion is used.

The middle conveying roller pair 54 is arranged above the processing tray 521. The middle conveying roller pair 54 is constituted by a conveying upper roller 54*a* and a conveying lower roller 54*b*. An alignment member 55 is provided below the middle conveying roller pair 54.

Figure 6:
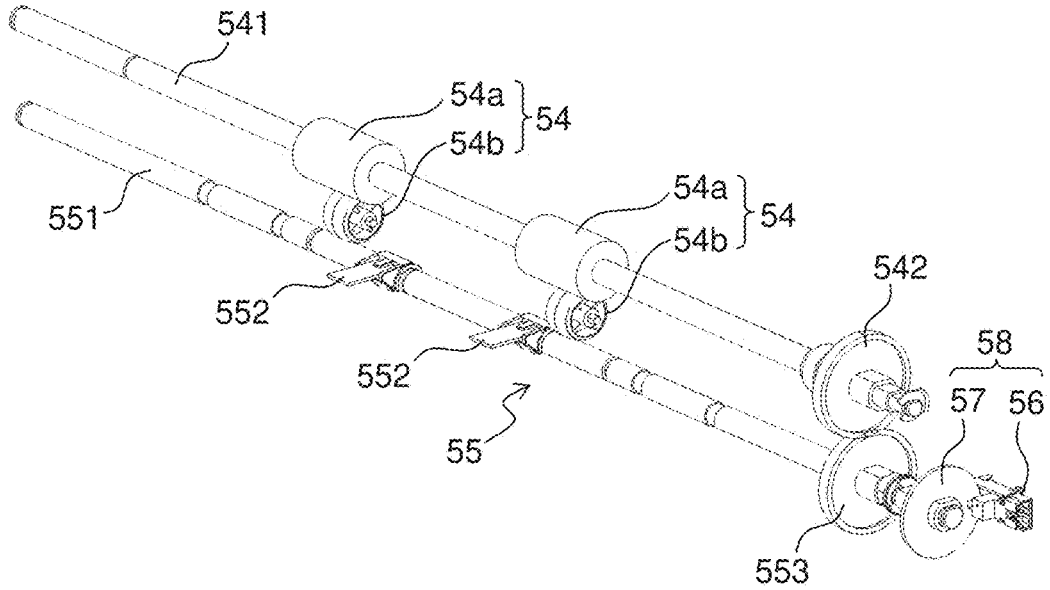
FIG. 6 is a perspective view of a middle conveying roller pair and an alignment member.

FIG. 6 is a perspective view of the middle conveying roller pair 54 and the alignment member 55. The middle conveying roller pair 54 is arranged at a plurality of points (two points in this embodiment) along the sheet width direction. A drive input gear 542 is fixed on a rotation shaft 541 of the conveying upper roller 54*a*. Rotational driving force from a roller drive motor M2 (refer to FIG. 5) is input to the drive input gear 542 and the conveying upper roller 54*a* is driven to rotate. The conveying lower roller 54*b* brought into pressed contact with the conveying upper roller 54*a*, rotates by following the conveying upper roller 54*a*.

The alignment member 55 moves (switches back) the sheets S to be carried in onto the processing tray 521 (refer to FIG. 5) in an alignment direction in which these sheets S come close to the reference plates 73. In this way, the alignment member 55 assists the alignment of the sheets S. The alignment member 55 includes a shaft 551 and an alignment paddle 552.

The shaft 551 is arranged parallel to the rotation shaft 541 of the conveying upper roller 54*a*. The alignment paddles 552 are fixed at a plurality of points (two points in this embodiment) on the shaft 551. The alignment paddles 552 are sheets of rubber and protrude in a tangential direction from the same phase position in the circumferential direction of the shaft 551.

A drive transmission gear 553 is fixed at a position on the shaft 551 where the drive transmission gear 553 meshes with the drive input gear 542. With this, rotational driving force from the roller drive motor M2 is transmitted to the shaft 551 via the drive input gear 542 and the drive transmission gear 553 and the alignment paddle 552 rotates. More specifically, with the roller drive motor M2, the alignment paddle 552 rotates in a direction in which the sheets S are sent out in the alignment direction (counterclockwise direction in FIG. 5). The alignment paddle 552 rotates while in contact with the top surface of the sheets S to be carried in onto the processing tray 521. In this way, the alignment paddle 552 moves the sheets S in the alignment direction, and thrust and thereby align the edges of the sheets S against the reference plates 73.

Used as the roller drive motor M2 is a stepping motor of which the rotation direction and the amount of rotation (angle of rotation) can be controlled accurately by pulse control.

A home-position detection unit 58 that detects a reference position (home position) of the alignment member 55 (alignment paddle 552) is provided. The home-position detection unit 58 includes a sensor unit 56 and a detection plate 57.

Figure 7:
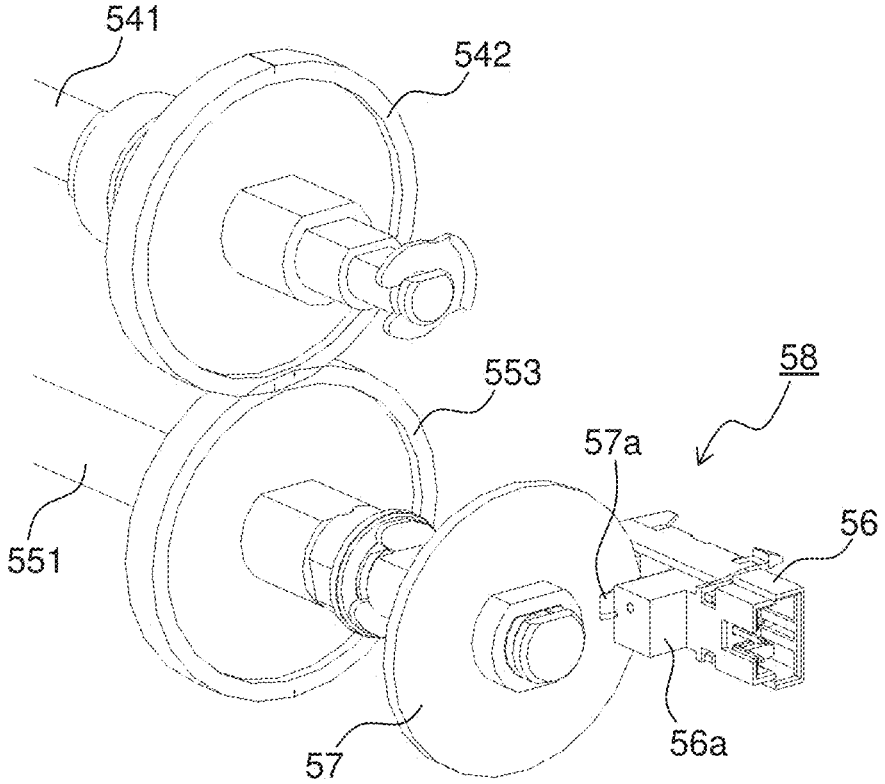
FIG. 7 is an enlarged view around a home-position detection unit in FIG. 6.

FIG. 7 is an enlarged view around the home-position detection unit 58 in FIG. 6. The sensor unit 56 is a transmission PI (photo-interrupter) sensor and includes a detection unit 56*a* constituted by a light emitting portion and a light receiving portion facing each other. The detection plate 57 is fixed to an end portion of the shaft 551. The sensor unit 56 is arranged such that the detection unit 56*a* sandwiches the outer circumferential edge of the detection plate 57.

A cutout 57*a* is formed in the outer circumferential edge of the detection plate 57. The cutout 57*a* is formed at a position where the output of the sensor unit 56 changes when the angle of rotation of the shaft 551 reaches the reference angle. The output of the detection unit 56*a* when the detection plate 57 rotates is the output of the home-position detection unit 58. The output of the detection unit 56*a* is transmitted as a detection signal to the post-processing control portion 10. The post-processing control portion 10, based on the output of the home-position detection unit 58, detects that the phase (rotation position) of the alignment paddle 552 is at the home position.

Figure 8:
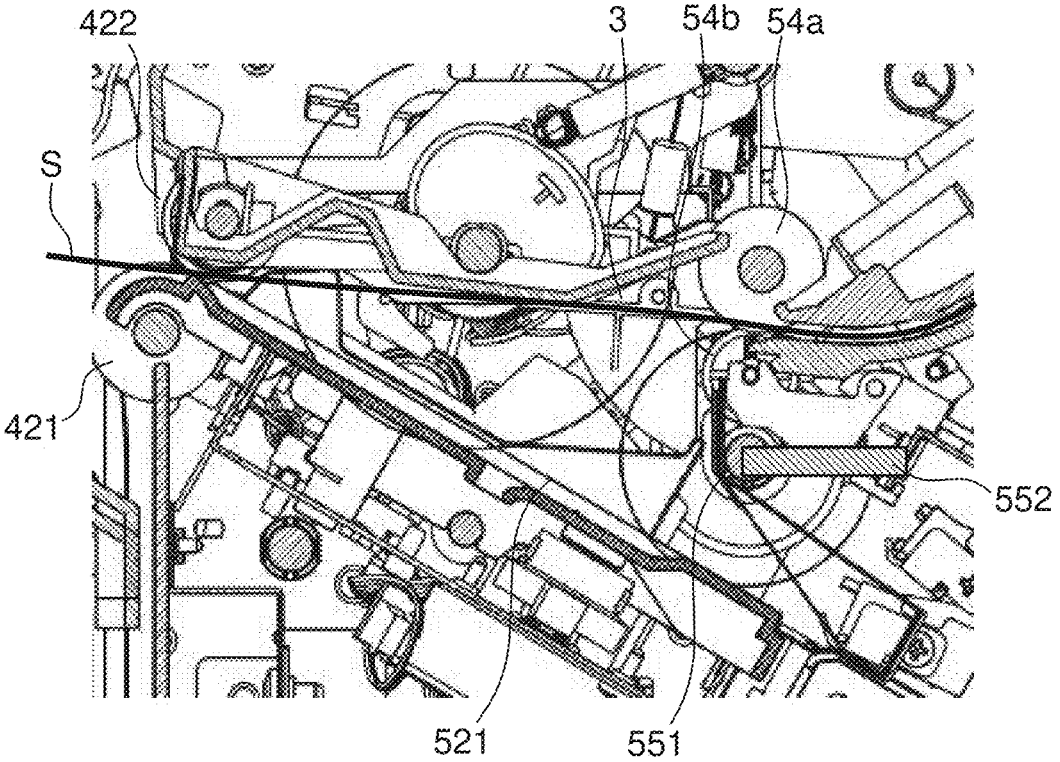
FIG. 8 is a sectional side view showing a structure around the alignment member, illustrating a state in which an alignment paddle is at the home position.

FIG. 8 is a cross-sectional side view showing a structure around the alignment member 55, the view illustrating a state in which the alignment paddle 552 is at the home position. In this embodiment, as illustrated in FIG. 8, the home position of the alignment paddle 552 is a position where the alignment paddle 552 has retracted from the first sheet-conveying path 3, more specifically, a position where the alignment paddle 552 has protruded substantially parallel to the first sheet-conveying path 3 toward the upstream side of the first sheet-conveying path 3 in the sheet conveying direction (right side in FIG. 8).

So long as the home-position detection unit 58 can detect the phase (rotation position) of the alignment paddle 552, any other configuration can be employed other than the configuration including the sensor unit 56 and the detection plate 57 as illustrated in FIG. 7.

[5. Phase Control for Alignment Paddle]

Figure 9:
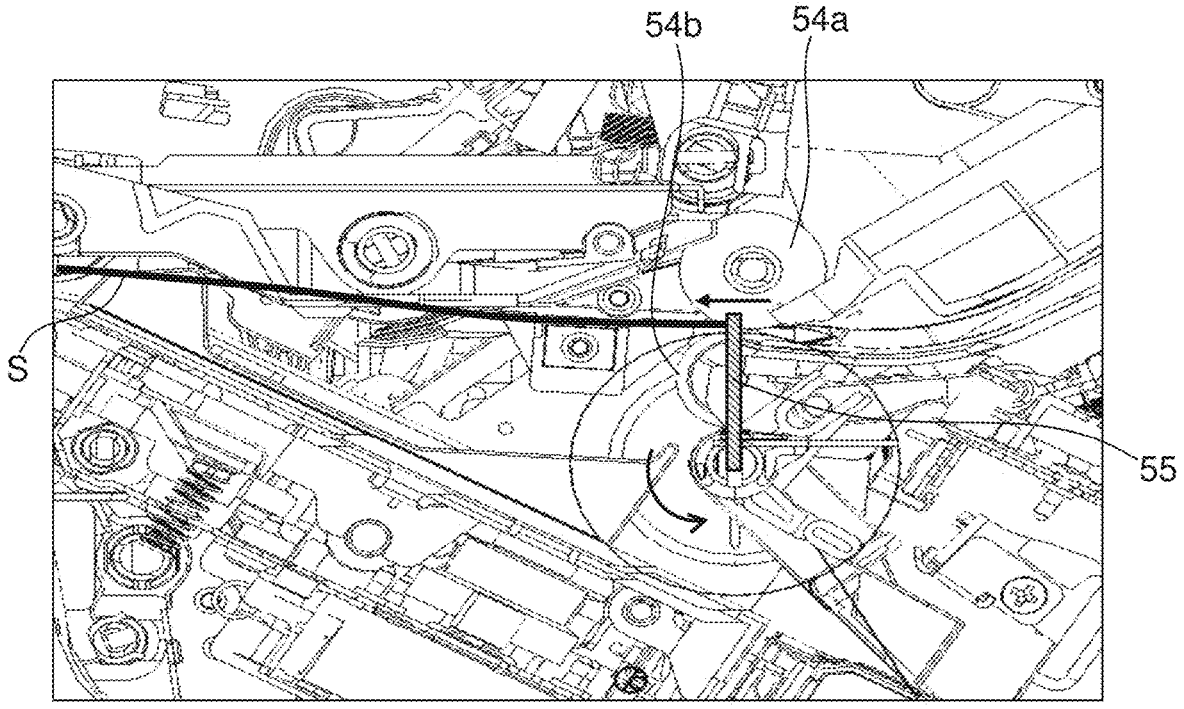
FIG. 9 is a sectional side view showing a structure around a processing tray and the alignment member, illustrating a state in which the alignment paddle is in contact with the trailing end of a sheet.

Now, phase position control for the alignment paddle 552 is described. As illustrated in FIG. 6, with the configuration according to this embodiment, the alignment member 55 is arranged below and close to the middle conveying roller pair 54. Thus, the rotational orbit of the alignment paddle 552 overlaps with the first sheet-conveying path 3 (the conveying orbit of the sheets S that pass through the middle conveying roller pair 54). FIG. 9 is a view illustrating a state in which the alignment paddle 552 is in contact with the trailing end of the sheet S. As illustrated in FIG. 9, depending on the phase position (rotation position) of the alignment paddle 552, the alignment paddle 552 may make contact with the trailing end of the sheet S being conveyed through the first sheet-conveying path 3 and push the sheet S out in the conveying direction. As a result, when the sheet S is drawn onto the processing tray 521, it may not be drawn to the desired position. This may make it difficult to convey and align the sheet S stably.

To cope with that, the present embodiment, if contact is likely between the sheet S being conveyed through the first sheet-conveying path 3 and the alignment paddle 552, the phase of the alignment paddle 552 is shifted to avoid contact with the sheets S.

Specifically, the post-processing control portion 10 calculates an interval in which the trailing end of the sheets S may make contact with the alignment paddle 552 (hereinafter, referred to as the contact assumed interval). If the timing (hereinafter, referred to as the interference timing) at which the alignment paddle 552 interferes (overlaps) with the first sheet-conveying path 3 due to the rotation of the alignment member 55 falls within the contact assumed interval, the post-processing control portion 10 transmits a control signal to the roller drive motor M2 and temporarily reduce (or increase) the rotation speed of the alignment member 55 (shaft 551).

Figure 10:
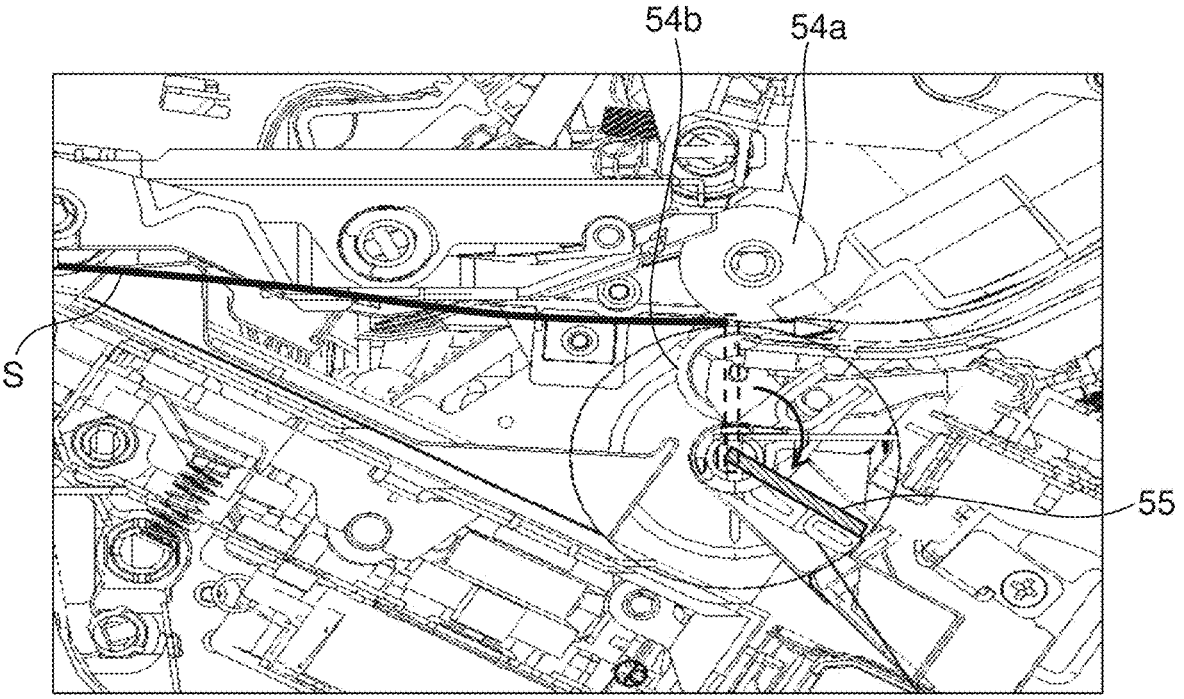
FIG. 10 is a sectional side view showing a structure around the processing tray and the alignment member, illustrating a state in which the phase of the alignment paddle is shifted to prevent contact with the trailing end of the sheet.

FIG. 10 is a view illustrating a state in which the phase of the alignment paddle 552 is shifted. Temporarily reducing (or increasing) the rotation speed of the alignment member 55 results in, as illustrated in FIG. 10, the phase of the alignment paddle 552 being at a position (position indicated by a solid line) displaced a predetermined angle from the position (position indicated by a broken line) before speed reduction (or speed increase). As described above, if the interfere timing of the alignment paddle 552 overlaps with the contact assumed interval, the phase of the alignment paddle 552 is shifted so that the interfere timing falls outside the contact assumed interval and thereby the alignment paddle 552 is prevented from making contact with the trailing end of the sheets S.

The interference timing of the alignment paddle 552 can be calculated based on the output of the home-position detection unit 58. Specifically, the timing when the alignment paddle 552 reaches the home position (refer to FIG. 8) can be detected based on the output of the home-position detection unit 58, and thus the interference timing is calculated based on the drive pulses of the roller drive motor M2 from the home position to the position of interference with the first-sheet conveying path 3 (refer to FIG. 9).

The contact assumed interval can be calculated according to a calculation formula stored in advance in the storage unit of the post-processing control portion 10 based on the conveying speed of the sheets S, the size of the sheets S in the conveying direction, and the conveying distance in the image forming apparatus 200 and in the sheet post-processing apparatus 1. The contact assumed interval, though it depends on conditions such as the conveying speed in the image forming apparatus 200 and the sheet post-processing apparatus 1, is about several millimeters to ten and several millimeters if expressed in terms of distance (mm). The contact assumed interval can be expressed also in terms of time (sec).

When the perforating unit 91 executes the perforating process onto the sheets S or when it performs registration correction (skew correction) in which the leading end of the sheets S is thrusted to the upstream side conveying roller pair 31 to make the sheets S sag, the time required for the perforating process and the time required for flexion formation and flexion elimination need to be considered. That is, when a predetermined post-processing is executed at the upstream side of the alignment paddle 552, the time required for the post-processing (post-processing time) need to be considered in calculating the contact assumed interval.

When the sheet post-processing apparatus 1 is designed, changing the parameters in the calculation formula permits the length of the contact assumed interval to be changed. For example, to prevent contact between the alignment paddle 552 and the trailing end of the sheets S more reliably, the parameters in the calculation formula are changed so as to extend the contact assumed interval to be calculated. By contrast, to prevent the phase position control for the alignment paddle 552 from being activated frequently, the parameters in the calculation formula are changed so as to shorten the contact assumed interval to be calculated.

Figure 11:
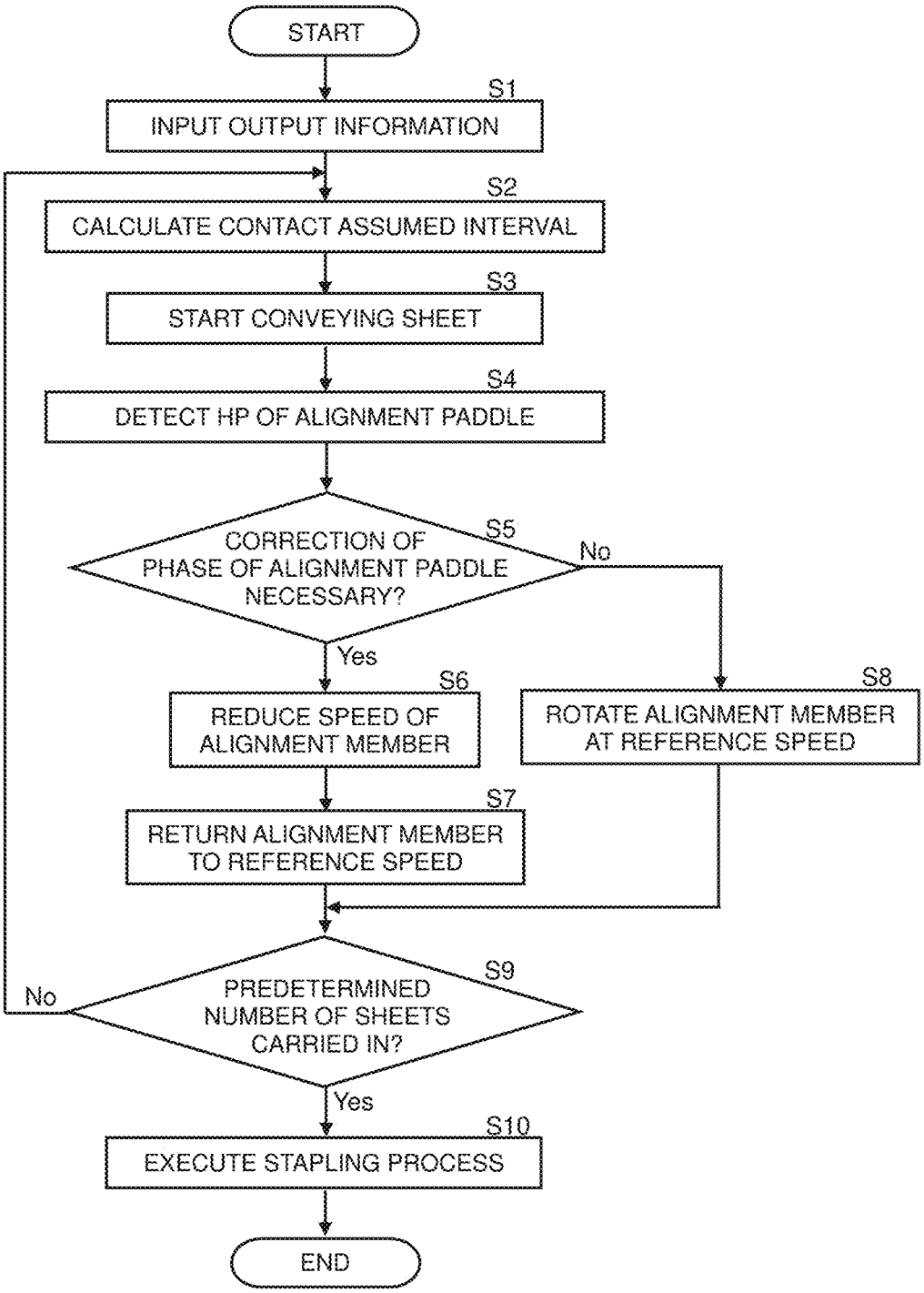
FIG. 11 is a flowchart showing an example of phase position control for the alignment member in the sheet post-processing apparatus according to the present embodiment.

FIG. 11 is a flowchart showing an example of the phase position control for the alignment paddle 552 executed in the sheet post-processing apparatus 1 according to the present embodiment. Referring back to FIG. 1 to FIG. 10 when necessary, a procedure of the phase position control for the alignment paddle 552 is described sequentially with reference to Steps in FIG. 11. Note that, in the following description, information about the size or conveying speed of the sheets S, post-processing executed onto the sheets S is simply referred to as "output information about the sheets S."

When a command to execute the binding process onto the sheets S is input from the main body control portion 203 in the image forming apparatus 200, the output information about the sheets S is input together with the command to execute the binding process (Step S1). Among the output information about the sheets S, information about the sizes of the sheets S is input via the operation panel 202 of the image forming apparatus 200. Specifically, a manufacturer, a trade name, a product number, and so on may be associated with the information about the types of corresponding sheets S, and stored in advance in the main body control portion 203. With this, only by selection of the manufacturer, the trade name, the product number, and so on of the sheets S by a user via the operation panel 202, the main body control portion 203 can recognize information about the sizes of the sheets S to be used.

Information about the conveying speed of the sheets S in the image forming apparatus 200 is transmitted from the main body control portion 203, based on a print mode (such as photo print mode, character print mode, and duplex print mode) to be fed from a host apparatus such as a personal computer or from the operation panel 202.

Information about the post-processing onto the sheets S is transmitted from the main body control portion 203, based on the kind of post-processing (such as binding process, perforating process, and registration correction) fed from a host apparatus such as a personal computer or from the operation panel 202.

On the basis of the obtained output information of the sheets S, the post-processing control unit 10 calculates the contact assumed interval of the alignment paddle 552 with the sheets S (Step S2). After that, the sheets S are started to be conveyed (Step S3).

Next, the post-processing control portion 10 detects the home position of the alignment paddle 552 (Step S4). Specifically, when the sheet detection sensor 53 detects the sheet S being carried in, the post-processing control portion 10 transmits a control signal to the roller drive motor M2 to rotate the middle conveying roller pair 54 and the alignment member 55 at a reference speed. Then, on the basis of the output of the home-position detection unit 58, the timing when the alignment paddle 552 reaches the home position is detected.

Next, the post-processing control portion 10 determines whether or not the correction of the phase of the alignment paddle 552 is necessary (Step S5). Specifically, on the basis of the contact assumed interval calculated in Step S2 and the home position of the alignment paddle 552 detected in Step S4, the post-processing control portion 10 determines whether or not the interference timing of the alignment paddle 552 overlaps with the contact assumed interval when the middle conveying roller pair 54 and the alignment member 55 is rotated at the reference speed.

If the interference timing of the alignment paddle 552 overlaps with the contact assumed interval, it is determined that the correction of the phase of the alignment paddle 552 is necessary. The determination of whether or not the correction of the phase of the alignment paddle 552 is necessary is executed in the interval (R1 in FIG. 5) after the leading end of the sheets S is detected by the sheet detection sensor 53 until it reaches the upper side conveying roller pair 31.

If it is determined that the correction of the phase of the alignment paddle 552 is necessary (Yes in Step S5), the post-processing control portion 10 transmits a control signal to the roller drive motor M2 to reduce the rotation speed of the roller drive motor M2 and thereby reduce the speed of the alignment member 55 from the reference speed (Step S6). After that, the alignment member 55 is returned to the reference speed (Step S7).

In this embodiment, the roller drive motor M2 is used as a drive source shared between the middle conveying roller pair 54 and the alignment member 55. Thus, when the speed of the roller drive motor M2 is reduced, not only the speed of the alignment member 55 but also the speed of the middle conveying roller pair 54 is reduced. To cope with that, the operation of reducing the speed of the alignment member 55 from the reference speed and then returning it to the reference speed is executed in the interval (R2 in FIG. 5) after the leading end of the sheets S passes through the upper side conveying roller pair 31 until it reaches the middle conveying roller pair 54.

By contrast, if it is determined that the correction of the phase of the alignment paddle 552 is not necessary (No in Step S5), the rotation speed of the roller drive motor M2 is not changed and the alignment member 55 continues to be rotated at the reference speed (Step S8).

The sheets S having passed through the middle conveyance roller pair 54 have their trailing end struck down by a tapping member (not shown) and fall onto the processing tray 521. The sheets S having fallen onto the processing tray 521 are drawn by the rotating alignment paddle 552 in the alignment direction (direction of the arrow B in FIG. 3 and FIG. 4) along the processing tray 521, are aligned in the sheet width direction by the width regulating members 523 (refer to FIG. 3), and are aligned in the carry-in direction by the reference plates 73 (refer to FIG. 3) and stacked.

Next, the post-processing control portion 10 determines whether or not a predetermined number of the sheets S have been carried in onto the processing tray 521 (Step S9). If the predetermined number of the sheets S have not yet been carried in (No in Step S9), the procedure is returned to Step S2, and the steps described above (Step S2 to Step S8) are repeated.

If the predetermined number of the sheets S have been carried in (Yes in Step S9), the post-processing control portion 10 transmits a control signal to the stapling-unit drive motor M1 (refer to FIG. 3) to move the stapling unit 71 to the predetermined stapling position. After the stapling unit 71 has moved to the predetermined stapling position, the post-processing control portion 10 transmits a control signal to the stapling unit 71 to make the stapling unit 71 execute the stapling process onto the plurality of sheets S that have been aligned by the reference plates 73 (Step S10) and then the phase position control for the alignment paddle 552 is ended.

In the example of control shown in FIG. 11, when the contact assumed interval calculated on the basis of the output information of the sheets S overlaps with the interference timing of the alignment paddle 552, the phase of the alignment paddle 552 is appropriately corrected. With this, it is possible to prevent the alignment paddle 552 from pushing the sheets S out, and thus to stably convey the sheets S and align them on the processing tray 521.

Since it is not necessary to suspend the rotation of the alignment member 55, how the sheets S are stacked on the processing tray 521 is less affected.

Driving the alignment member 55 and the middle conveying roller pair 54 with the same drive source (the roller drive motor M2) helps reduce the manufacturing cost and the size of the apparatus.

Before the sheets S reach the middle conveying roller pair 54, the operation of reducing (or increasing) the speed of the alignment member 55 to correct the phase of the alignment paddle 552 and then returning the alignment member 55 to the reference speed is ended. With this, when the roller drive motor M2 is used as a drive source shared between the middle conveying roller pair 54 and the alignment member 55, it is possible to prevent the conveyance of the sheets S being affected by the change in the rotation speed of the middle conveying roller pair 54.

By including in the output information of the sheets S the kind of post-processing such as the perforating process by the perforating unit 91 and registration correction, it is possible to calculate an appropriate contact assumed interval with consideration given to the kind of post-processing executed at the upstream side of the sheet binding unit 92. It is thus possible to reliably prevent contact between the alignment paddle 552 and the trailing end of the sheets S more.

The embodiment of the present disclosure described above is not meant to limit the scope of the disclosure, which can thus be implemented with various modifications made without departing from the spirit of the present disclosure. For example, in the embodiment described above, the alignment member 55 is provided below the middle conveying roller pair 54; instead, the middle conveying roller pair 54 can be constructed integrally with the alignment member 55 such that the alignment paddle 552 is attached to the rotation shaft of the conveying lower roller 54*b* in the middle conveying roller pair 54.

In the embodiment described above, the alignment paddle 552 is fixed at only one point in the circumferential direction of the shaft 551; instead, the alignment paddles 552 can be fixed at a plurality of points, at equal intervals, in the circumferential direction of the shaft 551.

In the embodiment described above, the roller drive motor M2 is used as a drive source shared between the middle conveying roller pair 54 and the alignment member 55. The present disclosure, however, is applicable also to a configuration where the middle conveying roller pair 54 and the alignment member 55 are driven with separate drive sources. In this case, the operation of reducing the speed of the alignment member 55 from the reference speed and then returning it to the reference speed can be executed after the leading end of the sheets S reaches the middle conveying roller pair 54.

While the above embodiment deals with an example where the sheet binding unit 92 executes the binding process onto the sheets S stacked on the processing tray 521, this is not meant to limit the present disclosure; a configuration is also possible where a shift discharge process or a folding process is executed onto the sheets S stacked on the processing tray 521.

While in the above embodiment the output information about the properties of the sheets S is input via the operation panel 202 of the image forming apparatus 200, the output information about the sheets S may be automatically acquired. For example, a media sensor may be arranged at an appropriate position along the sheet conveying path from the image forming apparatus 200 to the sheet post-processing apparatus 1 so that the size of the sheets S carried from the image forming apparatus 200 into the sheet post-processing apparatus 1 can be detected with the media sensor.

While the above embodiment deals with, as an example of the image forming apparatus 200, an ink-jet recording apparatus, instead an electrophotographic printer or an electrophotographic copying machine may be used as the image forming apparatus 200.

The present disclosure is applicable to sheet post-processing apparatuses that execute predetermined post processes onto a plurality of sheets.

What is claimed is:

1. A sheet post-processing apparatus, comprising:

a first conveying member which is configured to convey a sheet, the sheet including a plurality of sheets;

a processing tray on which the sheets that are carried in along a predetermined carry-in direction by the first conveying member are stacked;

a first processing unit which is configured to execute a predetermined post process onto the sheets that are stacked on the processing tray;

a reference plate which aligns the sheets in the carry-in direction by abutting against a downstream edge of the sheets in an alignment direction that is opposite to the carry-in direction of the sheets that are carried in onto the processing tray;

an alignment member having:

a shaft which is arranged above the processing tray and rotates, and one or more alignment paddles which protrude in a radial direction of the shaft and which make contact with the sheets having been carried in on the processing tray;

the alignment member rotating in the alignment direction on a surface facing the processing tray to move the sheets having been carried in on the processing tray in the alignment direction, thereby assisting in aligning the sheets;

a home-position detection unit which is configured to detect the alignment paddle being at a reference position;

a drive unit which is configured to drive the alignment member; and a control portion which is configured to control the drive unit, wherein, the control portion calculates a contact assumed interval in which a trailing end of the sheets carried in in the alignment direction may make contact with the alignment paddle based on output information of the sheets, calculates an interference timing at which the alignment paddle interferes with a carry-in path of the sheets based on a result of detection by the home-position detection unit, and if the interference timing falls within the contact assumed interval, the control portion temporarily changes a rotation speed of the alignment member from a reference speed to shift a phase of the alignment paddle so that the interfere timing falls outside the contact assumed interval.

2. The sheet post-processing apparatus according to claim 1, comprising:

one drive unit which is configured to drive and rotate the alignment member and the first conveying member, wherein the control portion, after temporarily changing the rotation speed of the alignment member from the reference speed, before the sheets reach the first conveying member, returns the speed of the alignment member to the reference speed.

3. The sheet post-processing apparatus according to claim 1, wherein the output information of the sheets includes a size in the conveying direction, a conveying speed, and a conveying distance of the sheets.

4. The sheet post-processing apparatus according to claim 1, further comprising:

one or more second processing units which are arranged on an upstream side of the processing tray in the sheet conveying direction, the second processing units being configured to execute a predetermined post process onto the sheets, wherein the output information of the sheets includes a time required for the post process in the second processing units.

5. The sheet post-processing apparatus according to claim 1, further comprising:

a sheet detection unit which is arranged on an upstream side of the first conveying member in the sheet conveying direction, the sheet detection unit detecting passage of the sheets, wherein the control portion, after the passage of the sheets detected by the sheet detection unit, calculates the interference timing.

6. The sheet post-processing apparatus according to claim 5, further comprising:

a second conveying member which is arranged on a downstream side of the sheet detection unit and on an upstream side of the first conveying member in the sheet conveying direction, the second conveying member conveying the sheets in the conveying direction, wherein the control portion, in an interval after a leading end of the sheets is detected by the sheet detection unit until the leading end of the sheets reaches the second conveying member, determines whether or not the interference timing falls within the contact assumed interval.

7. The sheet post-processing apparatus according to claim 6, wherein the control portion, after the leading end of the sheets passes through the second conveying member, changes the rotation speed of the alignment member from the reference speed and, before the sheets reaches the first conveying member, returns the speed of the alignment member to the reference speed.

8. The sheet post-processing apparatus according to claim 1, wherein the control portion calculates the contact assumed interval according to a calculation formula set in advance, and a parameter in the calculation formula can be changed so as to adjust a length of the contact assumed interval calculated.

9. An image forming system, comprising:

an image forming apparatus that is configured to form an image onto a sheet; and the sheet post-processing apparatus according to claim 1, the sheet post-processing apparatus being configured to execute a predetermined post process onto the sheet on which the image has been formed by the image forming apparatus.

10. The image forming system according to claim 9, wherein the output information of the sheets includes a conveying speed of the sheets in the image forming apparatus.

* * * * *